United States Patent [19]

Burgess

[11] Patent Number: 4,689,444

[45] Date of Patent: Aug. 25, 1987

[54] ELECTRICAL CABLE APPARATUS

[75] Inventor: J. Howard Burgess, Richardson, Tex.

[73] Assignee: Rockwell International Corporation, El Segundo, Calif.

[21] Appl. No.: 889,658

[22] Filed: Jul. 25, 1986

[51] Int. Cl.[4] ..... H01B 5/08

[52] U.S. Cl. ..... 174/128 R; 57/214; 57/218; 174/130; 174/131 R

[58] Field of Search ..... 174/128 R, 129 R, 130, 174/131 R; 57/214, 218, 230, 231

[56] References Cited

U.S. PATENT DOCUMENTS

| | | | |
|---|---|---|---|
| 437,310 | 10/1835 | Abraham | 174/128 R |
| 1,904,116 | 4/1933 | Baum | 174/128 R |
| 2,778,870 | 1/1957 | Nolan | 174/128 R |
| 3,231,665 | 1/1966 | Grimes, Jr. et al. | 174/128 R |
| 3,339,012 | 8/1967 | Hutchins, Jr. | 174/128 R |
| 3,345,456 | 10/1967 | Gilmore | 174/128 R |
| 3,428,867 | 2/1969 | Becker | 335/285 X |
| 3,527,044 | 9/1970 | Nation | 174/128 R |
| 3,609,611 | 9/1971 | Parnell | 335/302 X |
| 3,647,939 | 3/1972 | Schoerner | 174/130 X |
| 4,349,694 | 9/1982 | Vives | 174/128 R |

*Primary Examiner*—Morris H. Nimmo

*Attorney, Agent, or Firm*—Bruce C. Lutz; V. Lawrence Sewell; H. Fredrick Hamann

[57] ABSTRACT

A novel construction of a trailing wire antenna radiating element using conductive material in the central core wound in a direction opposite to the conductive material on the outer layer in the skin effect area to reduce AC impedance. To compensate for the strength lost with the conductive material in the core area, high tensile strength and non-magnetic material such as stainless steel or beryllium copper is used in the outer layer. For a given diameter wire cable, the present device has much lower impedance and much higher strength while remaining more flexible.

8 Claims, 7 Drawing Figures

ELECTRICAL CABLE APPARATUS

THE INVENTION

The present invention is generally concerned with electrical cable and, more specifically, an electrical cable having high tensile strength which may be used as a trailing VLF/LF aircraft antenna.

BACKGROUND

There are many examples in the prior art of cable which is both usable as a tow cable or cable having high tensile strength and for providing effective signal conduction at high frequencies. One such example is a Gilmore U.S. Pat. No. 3,345,456. The design shown in this patent is generally of the type used in the TACAMO system for signal transmission from airplanes. However, the design of cables in accordance with the referenced Gilmore patent and other similar designs presently used have suffered from short life due to stresses incurred upon being rewound on the storage reel and have also had problems with high signal impedances at the signal frequencies involved.

The prior art design also exhibited some torque unbalance as well as having excessive aerodynamic drag when deployed.

The present design improves upon all of the above-listed shortfalls of the prior art by using standard wire cable construction rather than a wrapped conductive strap on the outside, combining non-magnetic relatively high tensile strength wires with conductive wires in the outer surface of the cable and incorporating some conductive wires in the cable core wound in a direction opposite that of the wires on the outer surface or periphery of the cable.

The above alterations allow the cable to be produced on standard steel cable winding machines, thereby lowering the cost and improving the wire breaking strength such that it can be rewound onto a drum approxiately four times as often, have reduced the AC impedance, increased the radiation efficiency, and minimized torque unbalance along with increasing the aerodynamic efficiency.

It is thus an object of the present invention to provide an improved high tensile strength electrical cable.

Other objects and advantages of the present inventive concept will be apparent from a reading of the specifications and appended claims in conjunction with the drawings wherein:

FIG. 7 is a further embodiment wherein some of the solid wires in the core layer illustrated as 20 and FIG. 3 are replaced with substrands.

DETAILED DESCRIPTION

Figure 1:
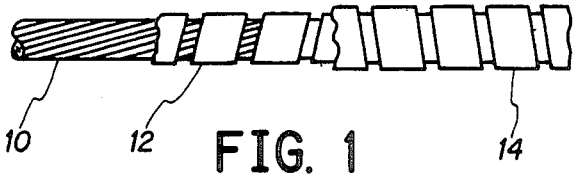
FIG. 1 PRIOR ART
FIG. 1 is a side view of a partially disassembled electric cable of the type used in the prior art.

In FIG. 1 a 1 by 19 steel core 10 is illustrated having a first lay direction with a copper strap layer 12 wound around the layer 10 in the same direction as the core. A second copper strap layer 14 is wound in the opposite direction.

Figure 2:
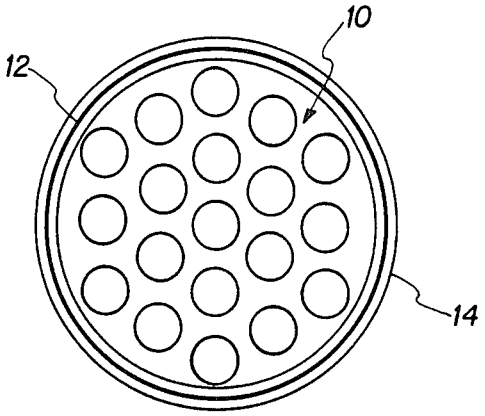
FIG. 2 PRIOR ART
FIG. 2 is a cross section of FIG. 1.

As will be apparent from the cross section illustration of FIG. 2, the 19 wires in the center would all be wound in the same direction. The typical wrap of this type is dignified with a name of a Warrington wrap and is merely a designation of a standard lay design in the cable industry. This center steel core is normally made of a high strength steel with the primary electrical conduction (approximately 98%) taking place in the two wraps 12 and 14 on the outside.

Figure 3:
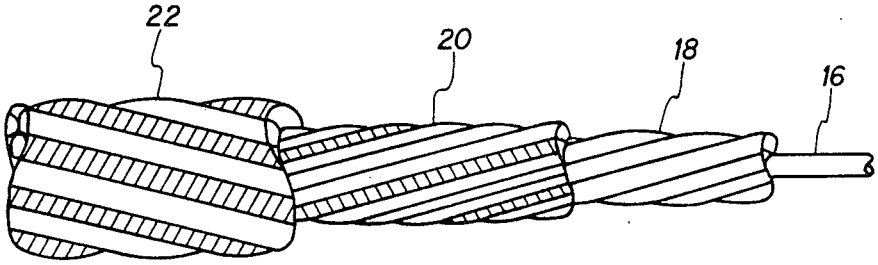
FIG. 3 is a side view of an electrical cable represented by the present invention.

FIG. 3 illustrates a cable assembled according to the present invention wherein a central wire 16 is surrounded by a wrap in a first or left-hand direction of six wires with this layer being designated as 18. A second layer also wrapped in the same direction is designated as 20 and comprises an additional 12 wires. Thus the sections of FIG. 3 comprising 16, 18, and 20 also constitute a 1 by 19 cable core since everything is wrapped in the same direction around the central wire 16. This core may be formed with the Warrington wrap. A final layer 22 comprises, in one embodiment of the inventive concept, 12 substrands each comprising seven wires in a substrand, wound in a direction opposite the core material and with adjacent substrands being either a conductive copper alloy or a non-magnetic material such as stainless steel. The non-magnetic material has a much higher tensile strength than the conductive material and has a neutral contribution to hysteresis and/or eddy current losses and other inductive losses such as occur in connection with the magnetic type steel wires in the core.

Figure 4:
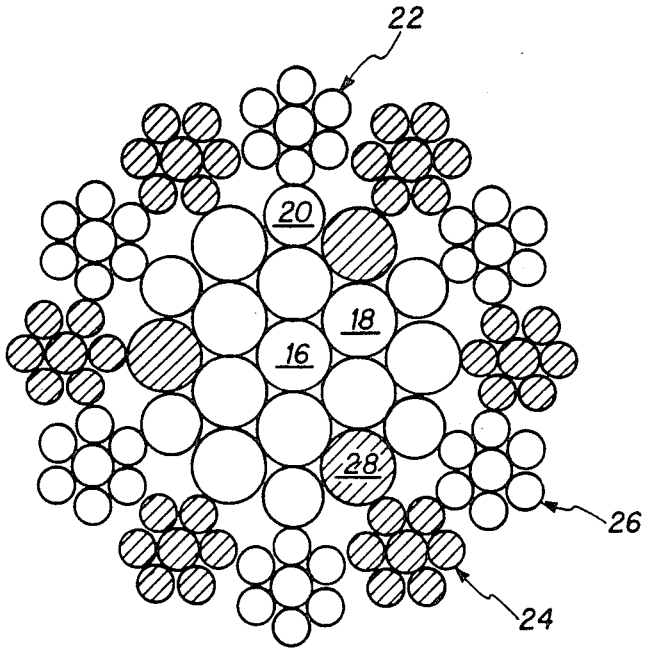
FIG. 4 is a cross section of the cable of FIG. 3.

In FIG. 4 the four different layers are further designated in the cross section with a specific substrand 24 being singled out as being a conductive substrand and cable 26 being singled out as being a non-magnetic substrand. Further, one of the wires in the core layer 20 is specifically designated as 28 indicating that it is one of three conductive wires whereas the remaining wires of various sizes in the embodiment illustrated are of high tensile strength rocket wire. This rocket wire needs to have at least 0.6 percent carbon and typically will have a carbon content of in the neighborhood of 0.8 to 1.0 percent carbon and will be a drawn wire for tensile strength in the 400,000 psi range. One embodiment of the invention used conductive wires such as 24 and 28 of cadmium copper and having a tensile strength somewhere in the range of 90,000 psi. (Typical hard drawn copper wire has a tensile strength in the range of 60,000 psi.) The non-magnetic material in one embodiment of the invention such as specifically designated as 26 in FIG. 4, was 305 stainless steel having a tensile strength in the neighborhood of 230,000 psi. As will be noted from the above, the stainless steel has a tensile strength intermediate that of the conductive wires and of the carbon steel wires. It may be further noted that the lay of the substrands, such as 24 and 26 in layer 22, both are wound in the same lay direction as the entire outer layer. In other words, in one embodiment of the invention, layers 18 and 20 each have a left lay whereas in layer 22 not only are the strands in each substrand a right lay but the substrands as a total layer 22 have a right lay.

Figure 5:
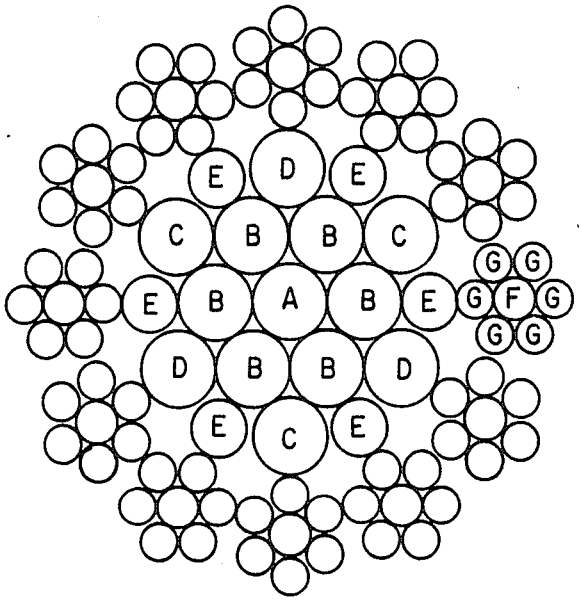
FIG. 5 is an enlarged cross section of an example cable for the purpose of describing alternate embodiments of the inventive concept.

In FIG. 5 each of the various wires in different wire groupings is given a designation. The wire designated in FIG. 3 as 16 is given a designation "A" whereas the wires in layer 18 is given a designation "B". The wires in layer 20 are given designations "C", "D" and "E". The wires in layer 22 are given the designations "F" and "G". The total cable of FIG. 5 can be constructed in many different forms. Any of the solid wire elements in the core can be designated to be either solid wires or further stranded. Likewise, the outside element such as 24 or 26 in FIG. 4 may be either stranded or solid wires. Finally, any of the individual substrands may either be composed entirely of magnetic material or may be a mixture wherein wire "F" is non-magnetic surrounded by conductive material or the wires "G" may be a mixture of conductive and non-magnetic material. The various potential configurations provide a large assortment of variations for strength of cable versus size versus conductivity, both AC and DC, and aerodynamic resistance.

Also, many different conductive elements may be used besides cadmium copper. If cost is no object, a reasonably high tensile strength conductive element such as beryllium copper may be used which would also be non-magnetic in place of stainless steel. In such an event the effort would be to maximize AC conductivity with maximum achievable tensile strength and economy of production being relatively less important.

Figure 6:
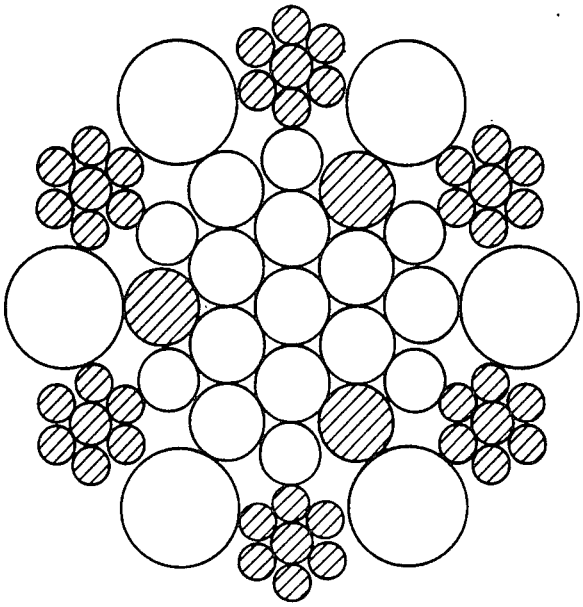
FIG. 6 is a further alternate embodiment using solid wires in place of some of the substrands.
Figure 7:
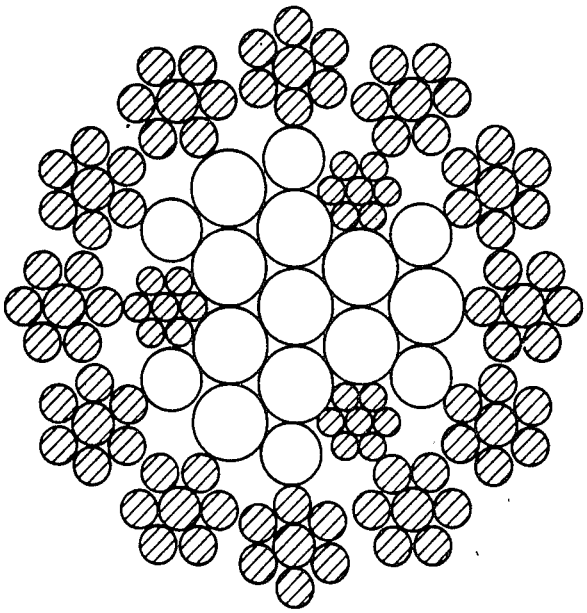

As referenced in the portion relating to the figures, the illustrations of FIGS. 6 and 7 show further embodiments somewhat as detailed above.

OPERATION

As illustrated in FIGS. 1 and 2 representing the prior art TACAMO cable design, it is known in the prior art to use steel core surrounded or wrapped with copper straps to achieve high strength, flexibility and signal conductivity for radiating signals from an antenna wire. It is further known to mix copper or aluminum alloys with lower strength aluminum or copper wires to produce higher strength transmission line electric cables. Typically, the alloys are centrally located and the lower strength conductive wires are on the outer surface of the cable in the skin effect area. It is also known from articles such as found in the "Transactions of the American Institute of Electrical Engineers", volume 78 in December 1959, page 1454, that if two opposite lay sets of aluminum strands are placed around a steel core that the electromagnetic fields of the layers will largely cancel one another thereby lowering the AC impedance. As further commented in this article, if three layers are used, the impedance rises slightly.

As far as is known, the present invention is the first instance where conductive wires have been combined in the steel core and used at a depth below the skin effect layer to provide a much lower A.C. impedance. This is illustrated by wires such as 28 in FIG. 4 or D in FIG. 5. This wrap or set of wires D in FIG. 5 are wound in the opposite direction or opposite lay of the outside wires illustrated as layer 22 in FIG. 3 or specifically, substrands 24 and 26 in FIG. 4. There is thus a cancellation of the magnetic effects and the AC impedance is considerably lower than the comparable size cable used in the prior art of FIG. 1. To make up for the loss in tensile strength by the replacement of steel wires with the conductive wires in FIG. 5, a high tensile strength, but lower conductivity wire, such as 26, is used in the periphery. This wire can not be a magnetic wire because the AC impedance would then remain high and the signal transmission would be compromised. Thus, a magnetic material such as stainless steel was chosen for its much greater strength over the conductor wire on the surface of the cable. The stainless steel does not substantially contribute to the eddy current losses but does significantly add to the strength such that having the same outer diameter as found in the prior art, the total strength of the resulting cable was increased by 20% while reducing overall weight by approximately 15%. The above was accomplished while radiation efficiency was increased by about half due to lower impedances and reduction in various losses. Side benefits from the use of the present cable are fuel savings in the aircraft towering the antenna and a lower threshold for corona along with a reduction in airborne drag tension. The design also increases by a factor of four the number of times that it can be wound on a storage reel and redeployed before the cable becomes unusable due to tendencies to fatigue failure and loosening of the outer wrap as is the case of the prior art.

Although several potential embodiments of the present inventive concept have been illustrated, I wish to be limited only by the concept of the invention as claimed in the attached claims which relate to a wire formed with conductive wires in the core at a depth below the skin effect layer and wrapped in a direction opposite the lay of the wires in the outer layer to decrease inductive losses. The resulting wire, to compensate for loss in tensile strength would then have high tensile strength wires in the periphery which are non-magnetic so as to maintain the low AC impedance intended to be obtained from the opposite direction wraps of conductive material while regaining the strength lost from the introduction of conductive wires in the steel core.

I thus wish to be limited only by the appended claims wherein I claim:

1. Electrical cable means comprising, in combination:

a center substrand comprising a central high tensile strength wire and at least one layer of side-by-side helical wires arranged in a first lay set of a first direction surrounding the central wire;

at least one further layer of side-by-side helical wires surrounding the first lay set, comprising both high tensile strength wires and high conductivity wires arranged in a second lay set of the same direction as said first lay set; and at least one outside layer of side-by-side helical substrands surrounding said at least one further layer, comprising a third lay set in a direction opposite said first direction with wires comprising the individual substrands also having a lay in the same direction opposite said first direction, some of said substrands in said at least one outside layer comprising non-magnetic wires having a tensile strength intermediate the tensile strength of the high tensile strength wires and the high conductivity wires in the at least one further layer and the remaining wires in the at least one outside layer comprising high conductivity material similar to that used for high conductivity in said at least one further layer.

2. Electrical cable means comprising, in combination:

a center substrand comprising a central high tensile strength wire and at least one layer of side-by-side helical wires arranged in a first lay set of a first direction surrounding the central wire;

at least one further layer of side-by-side helical wires surrounding the first lay set, comprising both high tensile strength wires and high conductivity wires arranged in a second lay set of the same direction as said first lay set; and at least one outside layer of side-by-side helical substrands surrounding said at least one further layer, comprising a third lay set in a direction opposite said first direction with wires comprising the individual substrands also having a lay in the same direction opposite said first direction, said substrands in said at least one outside layer comprising both non-magnetic wires, having a tensile strength intermediate the tensile strength of the high tensile strength wires and the high conductivity wires in said at least one further layer, and conductive wires.

3. Electrical cable means comprising, in combination:

a center substrand comprising a central high tensile strength wire and at least one layer of side-by-side helical wires arranged in a first lay set of a first direction surrounding the central wire and comprising both high tensile strength wires and high conductivity wires arranged in a first lay set of a first direction; and at least one outside layer of side-by-side helical substrands surrounding said first lay set, comprising a second lay set in a direction opposite said first direction with wires comprising the individual substrands also having a lay in the same direction opposite said first direction, said substrands in said at least one outside layer comprising both non-magnetic wires, having a tensile strength intermediate the tensile strength of the high tensile strength wires and the high conductivity wires in the at least one further layer, and conductive wires.

4. Low inductive loss electrical cable means, comprising, in combination:

a center substrand comprising a central carbon steel rocket wire having at least 0.6 percent carbon and at least one layer of side-by-side helical wires arranged in a first lay set of a first direction surrounding the central wire and comprising both rocket carbon steel wire having at least 0.6 percent carbon wire and cadmium copper wires arranged in a first lay set of a first direction; and at least one outside layer of side-by-side helical substrands surrounding said first lay set, comprising a second lay set in a direction opposite said first direction with wires comprising the individual substrands also having a lay in the same direction opposite said first direction, said substrands in said at least one outside layer comprising both stainless steel wires and cadmium copper wires.

5. A multiwire electrical cable comprising, in combination:

core means including both conductive wires for reducing inductive losses and high tensile strength wires for cable strength wound in a first lay direction; and outer wrap means, at least one skin effect thickness in depth, comprising both non-magnetic high strength wires and conductive wires and wound in a lay direction opposite said first lay direction for reducing unraveling tendencies.

6. A multiwire electrical cable comprising, in combination:

core means including both copper-cadmium wires and high tensile strength steel wires wound in a first lay direction; and an outer wrap, at least one skin effect thickness in depth, comprising stainless steel and copper-cadmium wires and wound in a lay direction opposite said first lay direction.

7. The method of decreasing the inductive losses in an electric cable having an inner core and an outer wrap required to have a high tensile strength comprising the steps of:

including conductive wires in a central core of an electric cable wrapped in a first lay direction; and including non-magnetic wires and conductive wires, the non-magnetic wires having a relatively high tensile strength as compared to the conductive wires, in an outer wrap around the central core wherein the outer wrap has a lay opposite said first lay.

8. The method of decreasing the inductive losses in an electric cable required to have a high tensile strength comprising the steps of:

wrapping conductive wires along with high tensile strength steel in a central core of an electric cable in a first lay direction; and wrapping conductive wires and non-magnetic wires in an outer wrap around the central core, the non-magnetic wires having a relatively high tensile strength as compared to the conductive wires, in the outer wrap wherein the outer wrap has a lay opposite said first lay.

* * * * *